United States Patent [19]

van Nes

[11] 4,110,760

[45] Aug. 29, 1978

[54] METHOD OF MANUFACTURING A CATHODE RAY TUBE FOR DISPLAYING COLORED PICTURES

[75] Inventor: Johannes Cornelis Adrianus van Nes, Eindhoven, Netherlands

[73] Assignee: U.S. Philips Corporation, New York, N.Y.

[21] Appl. No.: 652,075

[22] Filed: Jan. 26, 1976

[30] Foreign Application Priority Data

Mar. 27, 1975 [NL] Netherlands ..... 7503665

[51] Int. Cl.[2] ..... G03C 5/00

[52] U.S. Cl. ..... 354/1; 96/36.1

[58] Field of Search ..... 354/1; 96/36.1

[56] References Cited

U.S. PATENT DOCUMENTS

| | | | |
|---|---|---|---|
| 3,856,525 | 12/1974 | Inoue | 354/1 |
| 3,888,673 | 6/1975 | Suzuki et al. | 96/36.1 |
| 3,906,515 | 9/1975 | Hosokoshi et al. | 354/1 |
| 3,936,302 | 2/1976 | Takami et al. | 96/36.1 |
| 3,949,411 | 4/1976 | Yonai et al. | 354/1 |

FOREIGN PATENT DOCUMENTS

| | | | |
|---|---|---|---|
| 2,223,015 | 7/1973 | Fed. Rep. of Germany | 354/1 |
| 2,405,979 | 8/1974 | Fed. Rep. of Germany | 354/1 |

*Primary Examiner*—L. T. Hix
*Assistant Examiner*—Alan Mathews
*Attorney, Agent, or Firm*—Frank R. Trifari; Algy Tamoshunas

[57] ABSTRACT

The method of manufacturing a striped screen for a colored cathode-ray tube having a shadow mask with rows of elongate apertures. Adjacent apertures in each row are separated by a solid bridge. The photosensitized screen is exposed to light from a elongate light source parallel to the longitudinal directions of the apertures. By moving the light source uniformly during the exposure over a distance substantially equal to an integral number of times the length of the light source and the direction of the longitudinal axis, a line structure is exposed on the photosensitized screen, and the width of the lines is very constant.

3 Claims, 5 Drawing Figures

METHOD OF MANUFACTURING A CATHODE RAY TUBE FOR DISPLAYING COLORED PICTURES

The invention relates to a method of manufacturing a cathode ray tube for displaying coloured pictures and comprising a display screen and a shadow mask. The shadow mask has a number of parallel rows of elongate apertures, the apertures in each row being separated by bridges elongate in the direction of the rows. A photosensitive layer is provided on the display screen and the shadow mask in then arranged at some distance in front of the display screen after which the photosensitive layer is exposed, via the apertures in the shadow mask, to the light of an elongate light. The longitudinal axis of said light source extends in the direction of the rows, and the light source has a length such that the light distribution on the display screen behind the rows of apertures and the bridges between the apertures is of substantially constant width in the direction of the rows.

The invention also relates to a colour cathode ray tube manufactured according to said method.

The cathode ray tubes for displaying coloured pictures manufactured according to said method comprise in an evacuated envelope three electron guns for generating electron beams, a display screen having a large number of parallel strips luminescing in three different colours and a shadow mask in front of said display screen, which shadow mask has a number of parallel rows of apertures, which apertures are separated by bridges between the apertures of a row and are elongate in the direction of the rows. The luminescent strips are provided on the display screen by means of the photographic process described in the first paragraph.

In published German Patent Application 2,223,015 an elongate light source is described for exposing the display screen through the aperture in the shadow mask. The light source should be so long that the light intensity behind the rows of apertures in the shadow mask and the bridges present between the apertures is substantially homogeneous in the direction of said rows. For that purpose the light contribution per $cm^2$ and per unit of time behind a brdige of the shadow mask should be as large as that behind an aperture. This results in luminescent strips on a part of the display screen which have the same width substantially everywhere although, nevertheless, small variations in the width of the luminescent strips behind the bridges in other parts of the display screen occur. The cause of this is that the distance L from the centre of the light source to the display screen and the distance $q$ from the shadow mask to the display screen are not constant throughout the display screen and it is these parameters which determine the required length of the light source. If a light source having one given fixed length is used as in published German Patent Application 2,223,015, then it is either too long or too short for certain parts of the display screen. The result of this is that small widenings and constrictions respectively of the strips will occur at those areas. Although these widenings and constrictions are smaller than those which would occur when a light source of an arbitrary length is used, they are nevertheless so large that they adversely influence the picture quality of the manufactured cathode ray tube.

In published German Patent Application 2,405,979 that problem has been recognized and a partial solution is given. This partial solution involves exposing the display screen to light from a moving punctiform light source. For that purpose the punctiform light source is moved up and down over such a distance that a quasi-elongate light source is created having a length l between the values $l_0$ and $l_1$ which represent, respectively the minimum and maximum light source length necessary for exposing various places on the display screen. This method is complicated and does not give satisfactory results. In addition, the exposure take a long time.

It is an object of the invention to provide a method of manufacturing cathode-ray tubes for displaying coloured pictures in which small constrictions and widenings of the strips in so far as they adversely influence the picture quality are prevented all over the display screen and in which the whole display screen is exposed to light at one time.

According to the invention, a method of the kind mentioned in the preceding paragraph is characterized in that, during the exposures the elongate light source is moved at a constant speed over a distance substantially equal to an integral number of times the length of the light source in the direction of the rows of apertures.

The invention is based on the recognition that the variations in the light distribution which cause the constrictions and widenings and are a result of the light source being too short or too long are distributed over a distance equal to once or more times the distance between two successive bridges if the light source is moved uniformly over an integral number of times its own length.

An additional advantage is that defects in the strips as a result of variations in the distance shadow mask-display screen which may occur upon placing the shadow mask in front of the display screen are also distributed.

This distribution does not take place in the moving punctiform light source. Actually, it approaches only a stationary quasi-elongate light source.

The light source length l in which with a stationary linear light source no widenings and constrictions occur for a part of the display screen may be represented by the relation $$l = a \cdot n \cdot (L-q/q) \qquad (1),$$

wherein

- $a$ is the distance between the centres of two successive apertures in a row,
- L is the distance from the centre of the light source to that part of the display screen,
- $q$ is the distance from the shadow mask to that part of the display screen,
- $n$ is an integer larger than or equal to 1.

In that case the light contributions behind a bridge which pass through two adjoining apertures when added together are substantially as large as the light contribution behind an aperture.

A light source having a length l as defined by equation (1); need be moved uniformly only over a distance k, where $$k = a \cdot m \cdot (L-q/q) \qquad (2)$$

$m$ is an integer larger than or equal to 1 and smaller than $n$.

This follows from the fact that a light source having a length according to relation (1) is formed from $n$ partial light sources having a length $$l = a(L-q/q) \quad (3)$$

which are each moved uniformly in the direction of the rows of apertures over a distance equal to an integral number of times their length.

So it is obvious that the movement of an elongate light source having a length according to relation (1), wherein $n$ is larger than 1, also falls within the scope of this invention, since actually in that case a number of partial light sources having a length according to relation (3) are moved uniformly in the direction of the rows of apertures over an integral number of times the length of one of the said partial light sources.

The invention will now be described in greater detail with reference to the drawings, in which FIG. 1 shows diagrammatically a cathode ray tube manufactured according to the method of this invention;

Figure 1:
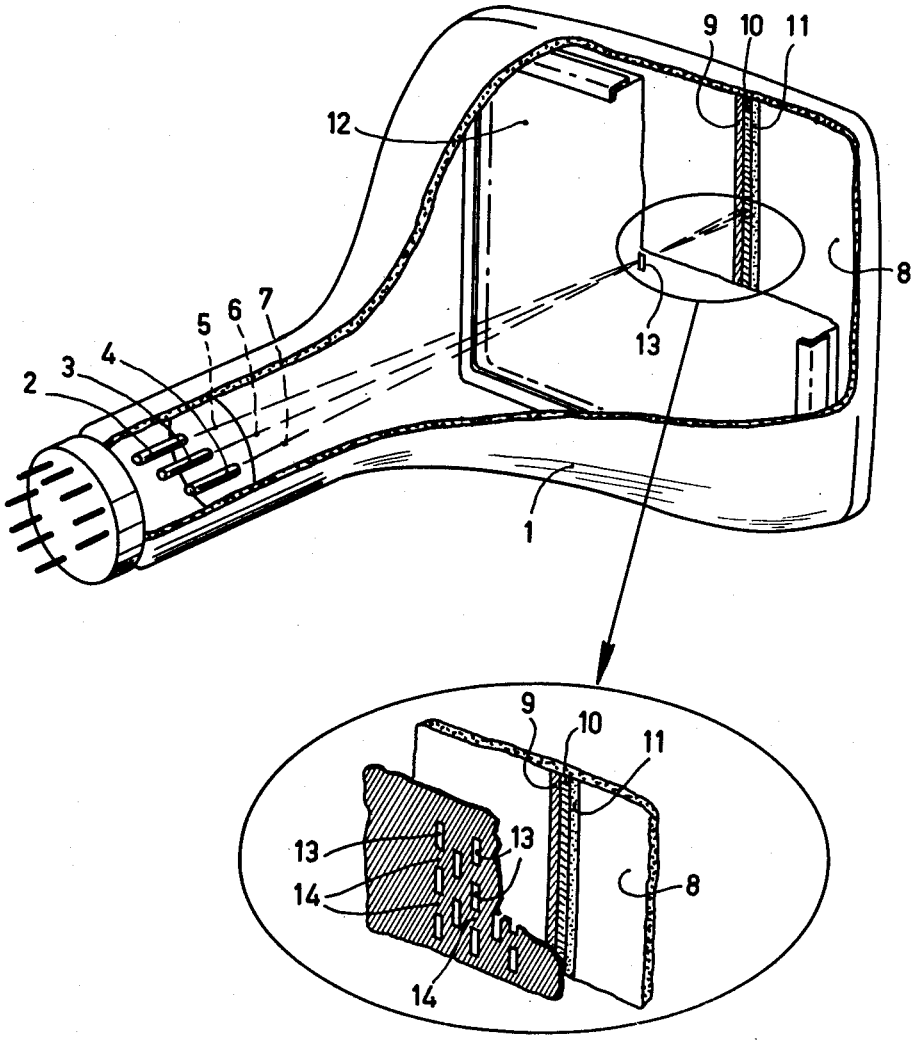

FIG. 1 shows diagrammatically a cathode-ray tube for displaying coloured pictures and manufactured according to the method described. In a glass envelope 1 are three electron guns 2, 3 and 4 with which are generated three electron beams 5, 6 and 7, shown diagrammatically, which impinge upon the display screen 8 via apertures 13 in the shadow mask 12. The electron guns 2, 3 and 4 are located in a plane which extends at right angles to the phosphor strips 9, 10 and 11 on the display screen 8.

When providing the phosphor strips on the display screen 8 by means of a photographic process according to the prior art, the exposure is carried out with a stationary elongate light source that exposes the screen through the shadow mask or, according to published German Patent Application 2,405,979, by means of a moving punctiform light source. A quasi-elongate light source is created by said moving punctiform light source and has such a length that relation (1) is always approximately satisfied.

The drawback to the use of a stationary elongate light source is that it has the correct length only for a part of the display screen. For the centre of the display screen, for example, the light source may be too long whilst it may be too short for the edge. As a result of this, and as shown by the single strip in FIG. 3, constrictions 15 are formed on the upper and lower sides of the phosphor strips on the display screen behind the bridges and 16 are formed in the centre.

The drawback to the use of a moving punctiform light source is that the entire display screen is not exposed at one time but in parts, which has a detrimental influence on the homogeneity of the phosphor strips. In addition, the distributing effect does not take place, since a stationary quasi-elongate light source is created.

Figure 2:
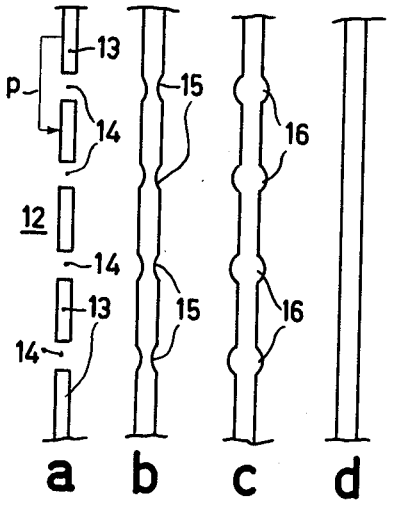
FIG. 2 shows various phosphor strips produced with and without using the method of this invention.

In FIG. 2 the left-hand column a denotes a number of holes 13 and bridges 14 in the shadow mask 12, while column b deontes the associated phosphor strip having constrictions on a part of the display screen which is present, for example, at the edge of the display screen above the centre when using a stationary elongate light source having a length $(l_0 + l_1/2)$, the average desired light source length, wherein $l_0$ and $l_1$ again are the minimum and maximum light source lengths, respectively, necessary for the exposure in different places in the display screen. The third column, column *c*, shows the shape of a phosphor strip having widening 16 at a part in, for example, the centre of the display screen obtained with a light source as shown at *b*. The right-hand column, column *d*, shows the desired shape in which no defects in the form of constrictions 15 and widenings 16 occur.

Figure 3:
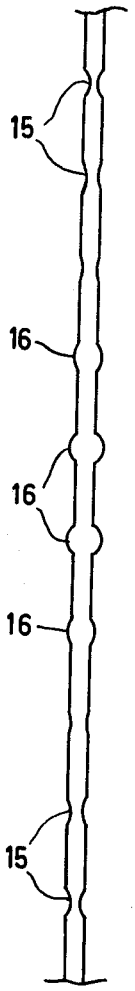
FIG. 3 shows the shape of a phosphor strip which is manufactured without using the method of this invention but using a stationary elongate light source, instead; a FIG. 4 shows the light intensity variation associated with the strips shown in FIG. 2.

FIG. 3 shows diagrammatically a whole phosphor line with the defects occurring due to use of a stationary elongate light source with the light source length as in column *b* in FIG. 2.

Figure 5:
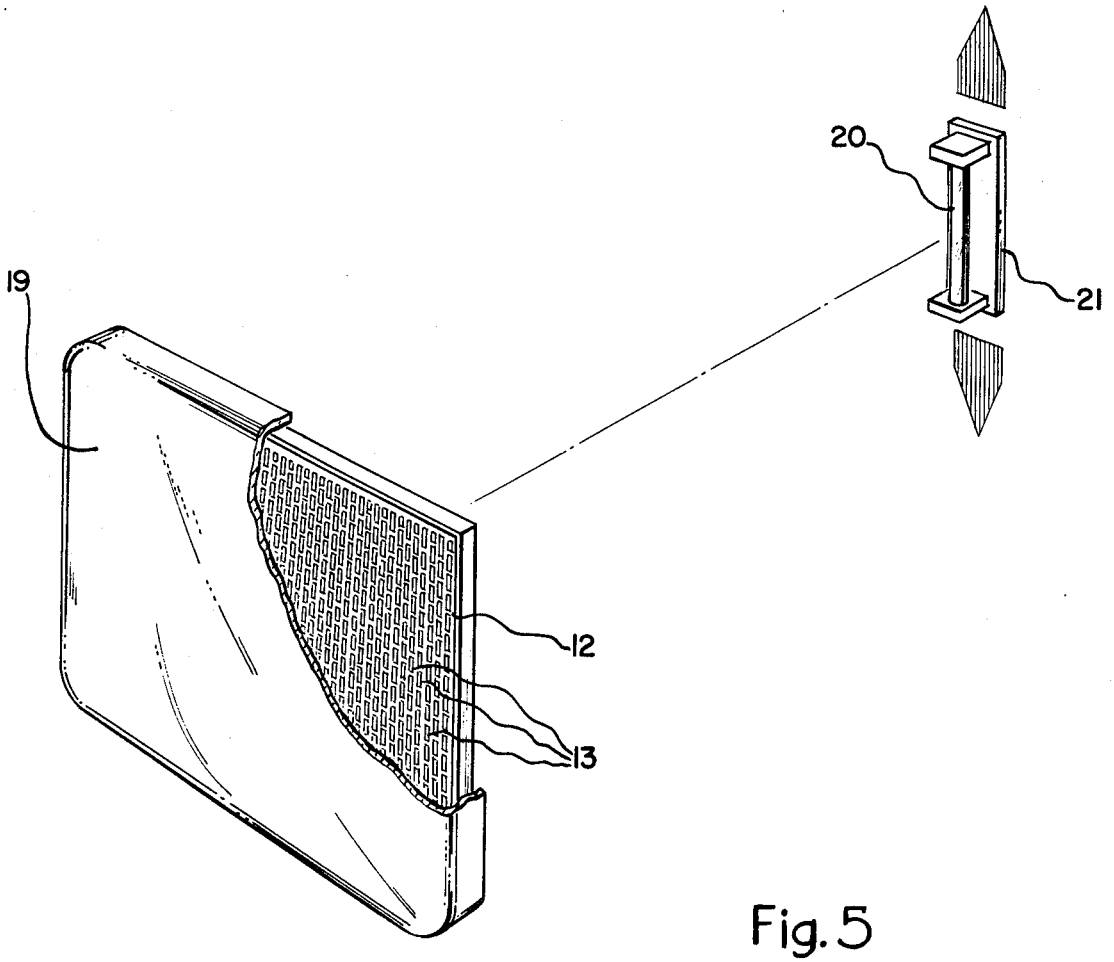
FIG. 5 diagrammatically shows the exposure of the photosensitive display screen in accordance with the method of the invention.

FIG. 5 diagrammatically illustrates the arrangement for exposing the phosphor on the screen in accordance with the invention. As shown in the FIG. 5, the elongate light source 20 is mounted on a movable stand 21 with the longitudinal axis of the source extending in a direction parallel to the direction of the rows of apertures 13 in the shadow mask 12. The light source 20 is moved in the direction of the rows of apertures 13, as indicated by the shaded arrows in FIG. 5, to expose, through the mask 12, the photosensistive material on the interior surface of the display panel or window 19 of the cathode ray tube.

Figure 4:
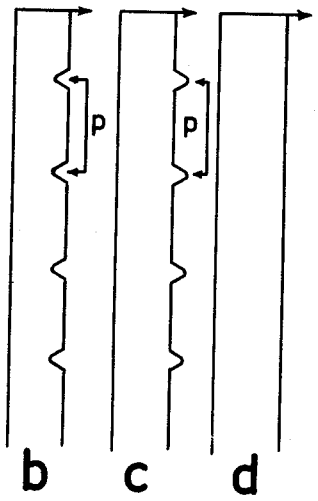

FIG. 4 shows graphs *b*, *c* and *d* that represents respectively the light intensity associated with columns *b*, *c* and *d* in FIG. 2. If, according to the invention, the elongate light source is moved during the exposure by a distance of, for example, one lamp length, the valleys in the intensity graph *b* in FIG. 4 and the peaks in the graph *c*, respectively, are distributed over one unit distance *p*, and a uniform light intensity distribution according to column *d* is obtained resulting in a phosphor strip *d* as shown in FIG 2. Since said distribution does not take place throughout the screen exactly over one period, very small undulations in the width of the strips will nevertheless be present. However, these are considerably smaller than the widenings 15 and constrictions 16 and constitute a non-annoying effect of a much lower order.

With a maks pitch, that is the distance between the centres of two successive apertures in a row, of 0.77 mm, for example $l_0 = 21.27$ mm and $l_1 = 25.24$ mm, without the use of the invention, line width defects in the form of constrictions and widenings larger than 15% would occur. By making the lamp length $(l_0 + l_1/2)$, or 23.25 mm, the line width defects are halved, and by using the invention they disappear substantially entirely and only very small undulations in the strip width remain.

I claim:

1. In the method of manufacturing a color cathode-ray tube comprisng a fluorescent screen and a support surface and a shadow mask spaced a distance *q* from said screen and having parallel rows of elongate apertures, the proximal ends of each pair of adjacent apertures in each of said rows being separated by a solid bridge and the centers of each of said pairs of apertures being spaced apart by a distance *a*, said screen being divided into strips of phosphors, each of said strips having substantially uniform width throughout its length, the steps comprising: exposing photosensitive material on the entire said surface to illumination passing through said apertures from a light source elongated in the direction parallel to said rows of apertures and spaced a distance L from said support surface, the length l of said light source being $$l = a \cdot n \cdot (L\text{-}q/q)$$

wherein $n$ is an integer; and moving the source of light longitudinally during exposure of said photosensitive material by a distance $k$, where $$k = a\, m\, (L\text{-}q/q)$$

and $m$ is an integer at least as great as 1 and not larger than $n$.

2. The method of claim 1 wherein said light source is moved uniformly while exposing said photosensitive material to light.

3. The method of claim 1 wherein $n$ is greater than $m$.

* * * * *

UNITED STATES PATENT AND TRADEMARK OFFICE

CERTIFICATE OF CORRECTION

PATENT NO. 4,110,760

DATED August 29, 1978

INVENTOR(S) : JOHANNES CORNELIS ADRIANUS VAN NES

It is certified that error appears in the above-identified patent and that said Letters Patent are hereby corrected as shown below:

Col. 2, line 44, should be --$l = a \cdot n \cdot (L-q)/q$--

Col. 2, line 62, should be --$k = a \cdot m \cdot (L-q)/q$--

Col. 4, line 3, should be --$\frac{l_o + l_1}{2}$ -- lines 52 and 53, should be --$\frac{l_o + l_1}{2}$ --

Col. 5, line 11, should be --$l = a \cdot n \cdot (L-q)/q$--

Col. 6, line 5, should be --$k = a \cdot m \cdot (L-q)/q$--

Signed and Sealed this

Fourth Day of December 1979

[SEAL]

Attest:

SIDNEY A. DIAMOND

Attesting Officer

Commissioner of Patents and Trademarks